United States Patent [19]

Kako et al.

[11] Patent Number: 5,069,564

[45] Date of Patent: Dec. 3, 1991

[54] PRINTING SYSTEM

[75] Inventors: Mitsumasa Kako, Toukai; Toshiki Morita, Toyoake; Motoji Wakita, Nagoya, all of Japan

[73] Assignee: Brother Kogyo Kabushiki Kaisha, Japan

[21] Appl. No.: 570,531

[22] Filed: Aug. 21, 1990

[30] Foreign Application Priority Data

Nov. 20, 1989 [JP] Japan ..... 1-301329

[51] Int. Cl.[5] ..... B41J 11/50

[52] U.S. Cl. ..... 400/605; 400/616; 400/692; 101/288; 156/584

[58] Field of Search ..... 400/605, 613.2, 614.1, 400/616, 616.1, 616.2, 614.3, 618, 635, 638, 639, 644, 120, 622, 692, 613, 613.1; 101/110, 288, 292, 295, 27, 69; 156/384, 584, 247, 542, 572

[56] References Cited

U.S. PATENT DOCUMENTS

| | | | |
|---|---|---|---|
| 4,036,132 | 7/1977 | Ellefson | 101/288 |
| 4,040,346 | 8/1977 | Orlens | 101/288 |
| 4,041,863 | 8/1977 | Mullen et al. | 101/288 |
| 4,422,376 | 12/1983 | Teraoka | 101/69 |
| 4,542,690 | 9/1985 | Kikuchi | 101/27 |
| 4,643,603 | 2/1987 | Hauslaib | 400/616.1 |
| 4,685,815 | 8/1987 | Baranyl | 400/54 |
| 4,688,597 | 8/1987 | Prevignano | 400/613.1 |
| 4,732,642 | 3/1988 | Ametani | 156/584 |
| 4,744,680 | 5/1988 | Hirosaki et al. | 400/613 |
| 4,769,103 | 9/1988 | Kopke et al. | 156/584 |
| 4,479,843 | 10/1984 | Neuhard et al. | 101/288 |
| 4,865,477 | 9/1989 | George | 400/622 |
| 4,944,827 | 7/1990 | Lilly et al. | 400/605 |

FOREIGN PATENT DOCUMENTS

| | | | |
|---|---|---|---|
| 0173689 | 7/1984 | European Pat. Off. | 101/288 |
| 0147674 | 6/1988 | Japan | 400/616 |
| 2194488 | 3/1988 | United Kingdom . | |

*Primary Examiner*—Eugene H. Eickholt
*Attorney, Agent, or Firm*—Oliff & Berridge

[57] ABSTRACT

A printing system prints characters or figures on a label removably adhered to a backing web on a platen roller. Separating rollers are disposed on the downstream side of the platen roller. A backing web with labels fed out from the platen roller after printing is bent by the separating rollers. The backing web bent by the separating rollers is drawn out from the separating rollers by a backing web feeding mechanism. When the backing web is bent by the separating rollers and drawn out from the separating rollers by the backing web feeding mechanism, a label is peeled off from the backing web to which it has been adhered. The separating rollers and the backing web feeding mechanism are coupled in an integral relation to constitute a label separating device. The label separating device is removably supported on a body of the print system. A driving mechanism provided on the printing system body is coupled to the backing web feeding mechanism on the label separating device, an the backing web feeding mechanism is driven by the driving mechanism.

16 Claims, 6 Drawing Sheets

PRINTING SYSTEM

BACKGROUND OF THE INVENTION

1. Field of the Invention

This invention relates to a printing system having a function of printing on labels removably adhered to a backing web.

2. Description of Related Art

A typical printing system for printing on labels is disclosed, for example, in British Patent No. 2,194,488. In the printing system, in order to automatically peel a label printed on a platen roller from a backing web, two separating rollers are provided in parallel to each other on the downstream side of the platen roller in a paper feeding direction such that the backing web with labels fed out from the platen roller may extend in a zigzag fashion so as to peel a label from the backing web. Meanwhile, in order to draw out the backing web from the separating rollers, a pair of pull tractors are provided in a backing web feeding direction of the separating rollers such that engaging projections on outer peripheries of the pull tractor are engaged with sprocket holes on the opposite left and right side edges of the backing web and the pull tractors are rotated to draw out the backing web from the separating rollers.

When printing on normal print paper, the two separating rollers and the pull tractors need not be used or otherwise may interfere with feeding of paper, and accordingly, they are preferably removed from a body of the printing system. In the printing system of the construction described above, however, since the separating rollers and the pull tractors are securely secured to the printing system body, a user cannot be removed readily. Indeed it is possible to individually remove the parts using a screw driver or a like tool, but this is very cumbersome and is not practical.

SUMMARY OF THE INVENTION

It is an object of the present invention to provide a printing system which is convenient in use in that the separating rollers and a backing web feeding mechanism can be mounted and removed readily onto and from a printing system body, depending upon whether a backing web with labels or normal print paper is used.

A printing system of the present invention has a function of printing on a label removably adhered to a backing web on a platen roller. Further, the printing system of the present invention includes a label separating device which includes, as a unit, a pair of separating rollers for guiding a backing web with labels having passed the platen roller in a zigzag fashion to peel a label form the backing web, and a backing web feeding mechanism for feeding the backing web such that the backing web may be drawn out from the separating rollers. The label separating device is removably supported on a body of the printing system. Further, a driving mechanism is provided in the printing system body such that, when the label separating device is mounted in the printing system body, the backing web feeding mechanism is driven by the driving mechanism.

Since the label separating device is removably supported on the printing system body, a user can mount or remove the label separating device onto or from the printing system body depending upon whether the paper to be used is a backing web with labels or normal print paper. Since the label separating device includes an integral unit of the separating rollers and the backing web feeding mechanism, a user can mount or remove the label separating device very easily, and accordingly, the ease of operability of the printing system is great. If a user mounts the label separating device onto the printing system body, the backing web feeding mechanism is connected to the driving mechanism on the printing system body side and thus performs a paper feeding operation. Consequently, a backing web after having passed a printing station is fed with certainty by the backing web feeding mechanism. Accordingly, the label separating device is can coact reliably with the stable backing web, and a label is peeled with certainty from the backing web.

BRIEF DESCRIPTION OF THE DRAWINGS

Preferred embodiments of the present invention will be described in detail with reference to the following figures wherein.

DESCRIPTION OF THE PREFERRED EMBODIMENTS

A printing system of a first embodiment of the present invention is first described below with reference to FIGS. 1 to 7.

Figure 7:
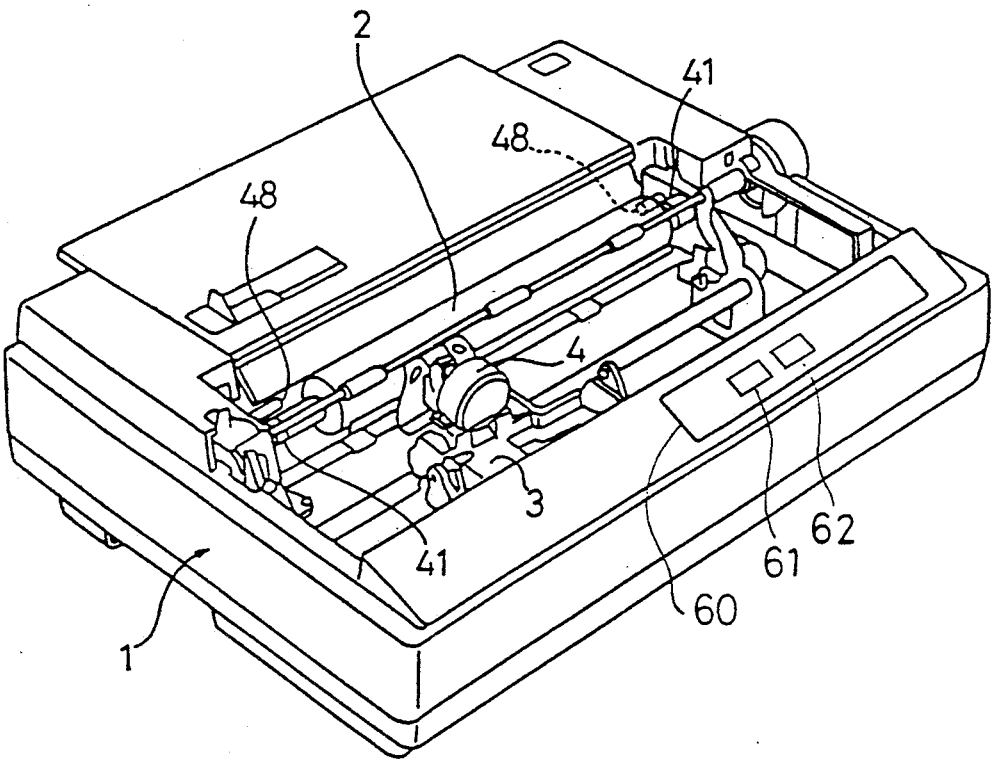
FIG. 7 is a perspective view of the entire printing system of FIG. 1 when the label separating device is removed.

Referring first to FIG. 7, a platen roller 2 and a carriage 3 are provided in a body of the printing system. The carriage 3 is mounted movably leftward and rightward along the platen 2 and has a print head 4 disposed thereon in an opposing relationship to the platen roller 2.

Figures 1, 2:
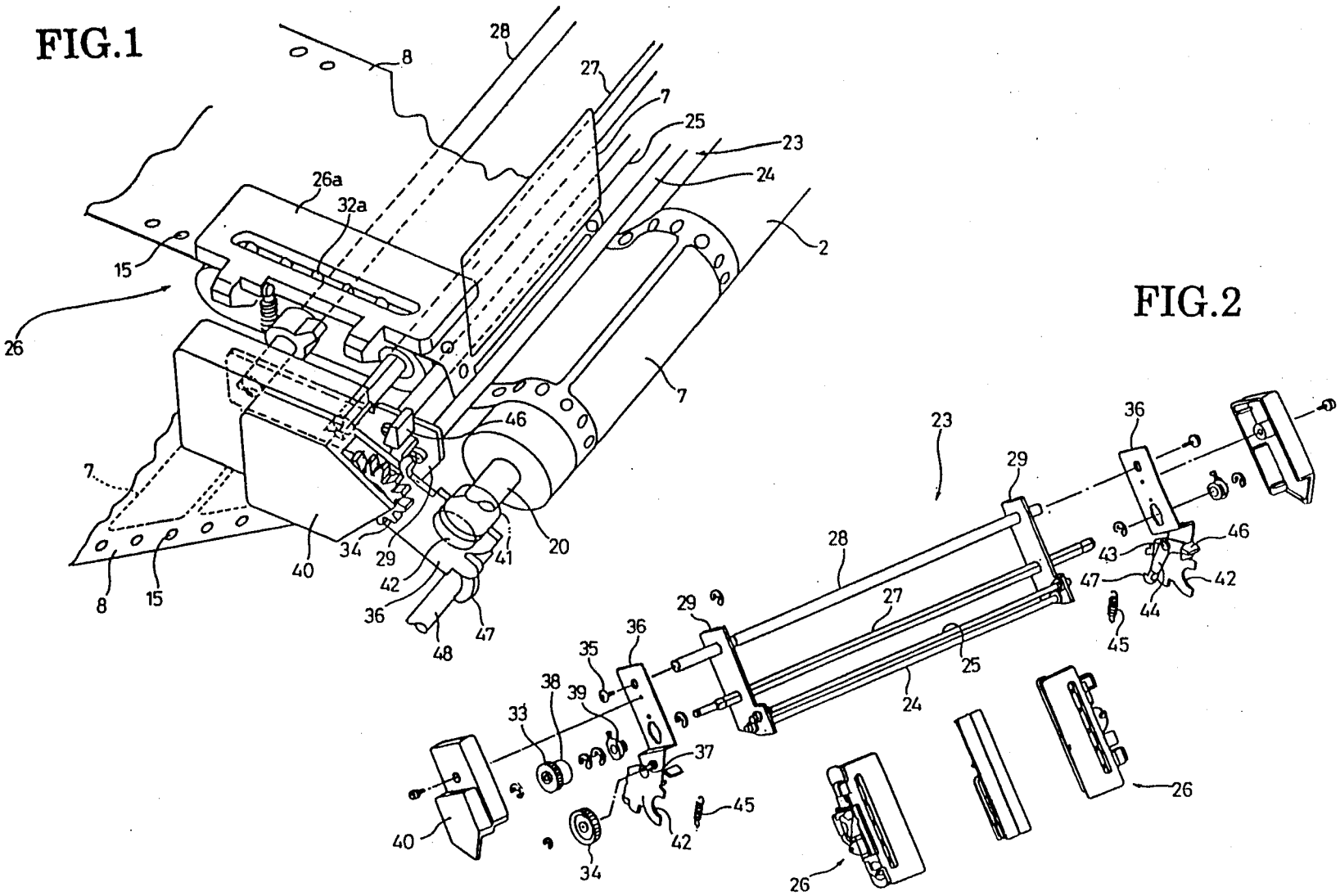
FIG. 1 is a perspective view of part of a printing system showing a first embodiment of the present invention.
FIG. 2 is a fragmentary perspective view of a label separating device of the printing system shown in FIG. 1.
Figure 3:
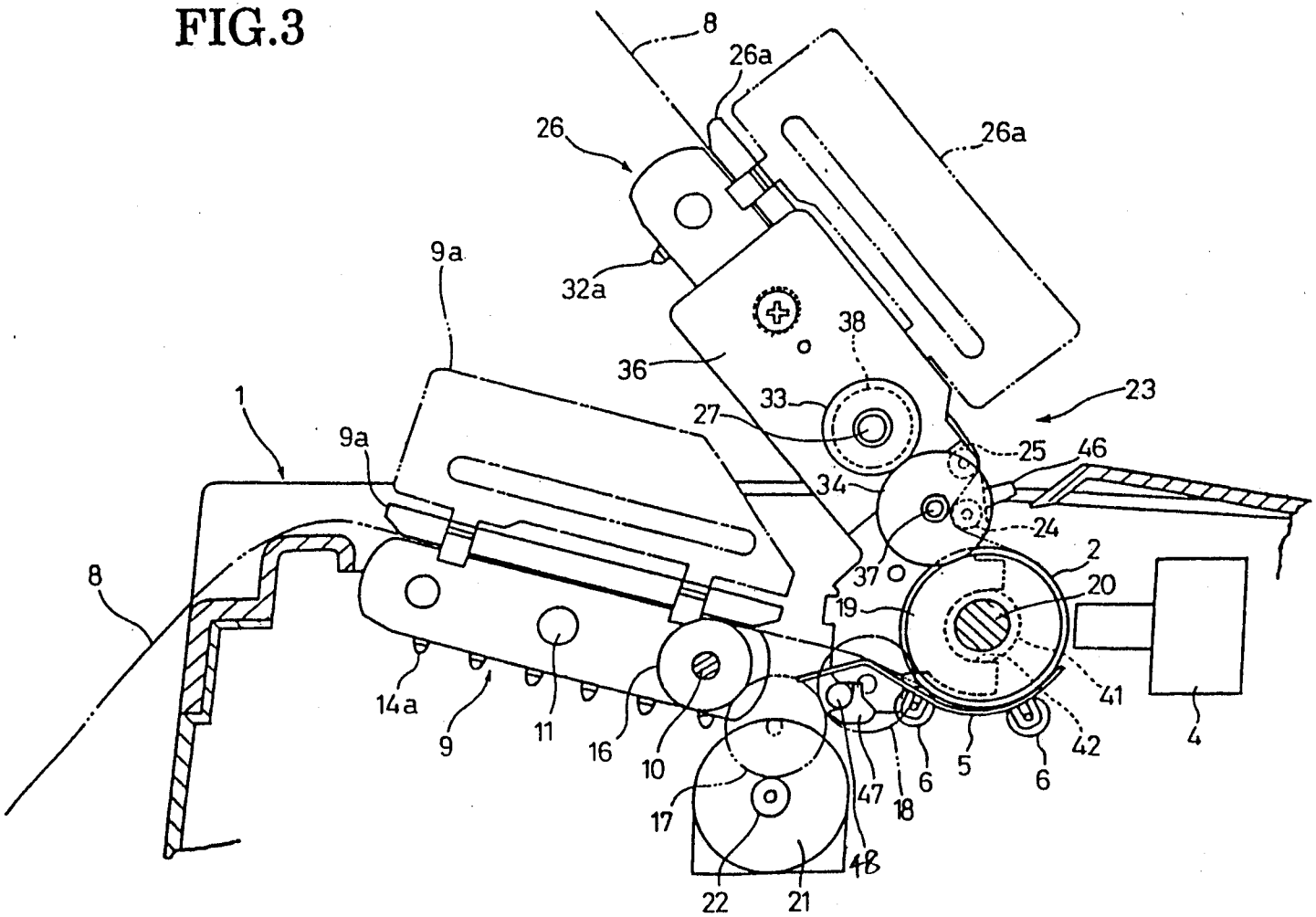
FIG. 3 is a vertical sectional side elevational view showing a feeding passage for print paper (a backing web with labels) of the print system shown in FIG. 1.
Figure 4:
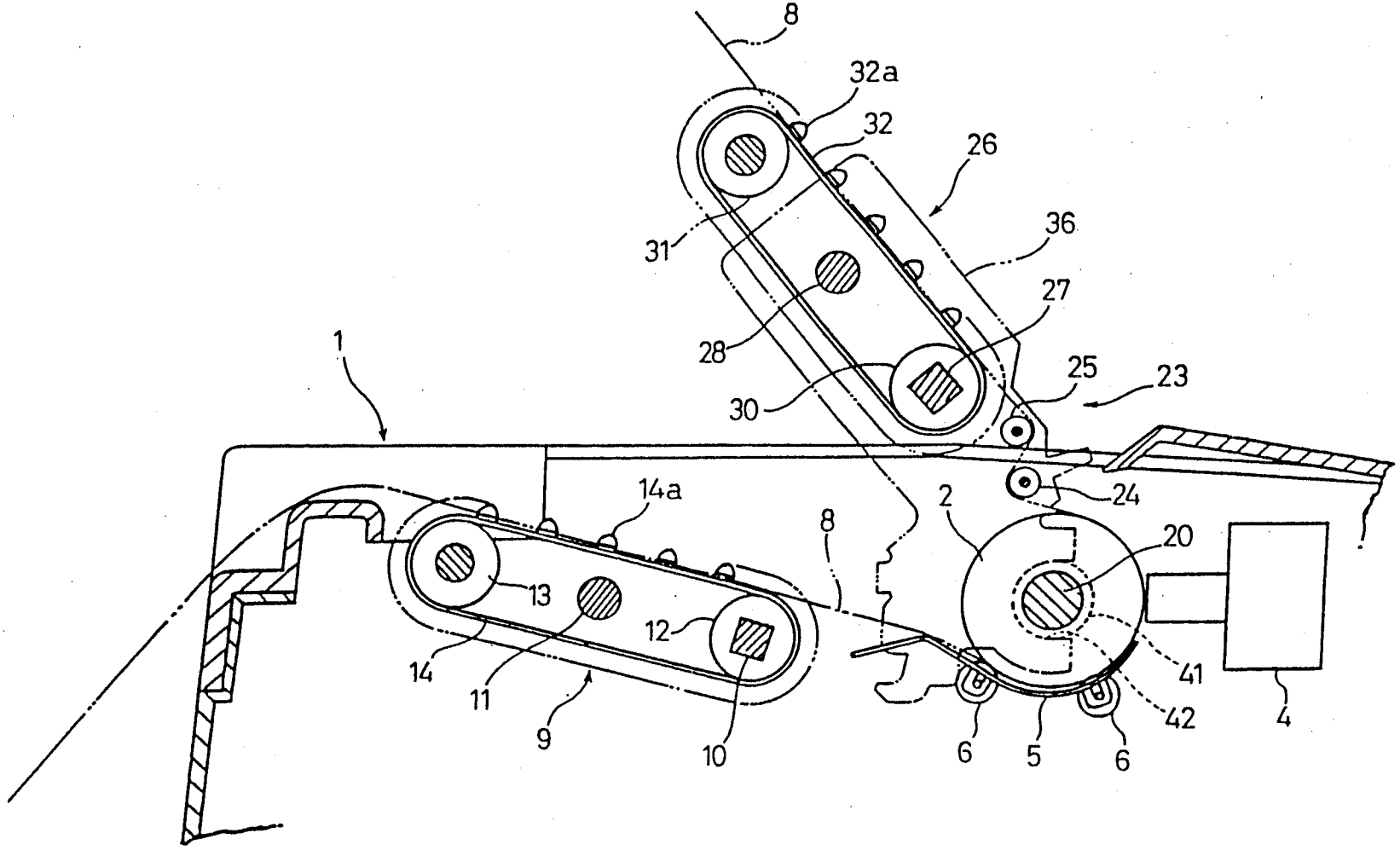
FIG. 4 is a vertical sectional side elevational view illustrating internal structures of a tractor and a pull tractor of the printing system shown in FIG. 1.
Figure 5:
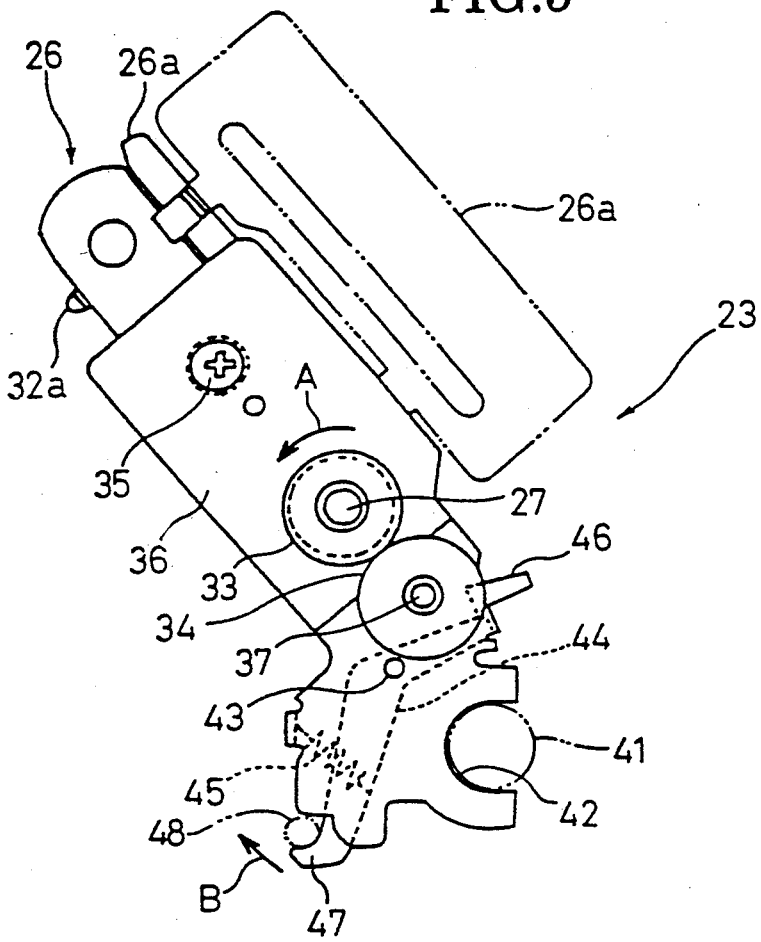
FIG. 5 is a side elevational view of the label separating device shown in FIG. 2.

Referring now to FIGS. 3 and 4, a paper guide plate 5 is disposed below the platen roller 2, and a plurality of paper holding rollers 6 are rotatably supported on the paper guide plate 5. The paper holding rollers 6 and the platen roller 2 are so disposed that print paper such as, for example, a backing web 8 with labels 7 may be introduced between them. A pair of tractors 9 for feeding such print paper as the backing web 8 to the platen roller 2 are provided on the opposite left and right sides behind the platen roller 2. The tractors 9 are supported on a drive shaft 10 and a guide shaft 11 extending in parallel to the platen roller 2 such that they may be adjusted in a widthwise direction of the print paper or backing web 8. A pair of belts 14 extend between drive pulleys 12 (refer to FIG. 4) fitted on the drive shaft 10 and corresponding follower pulleys 13 disposed behind the drive pulleys 12. Engaging projections 14*a* are provided on outer peripheries of the belts 14 and adapted to engage with sprocket holes 15 (refer to FIG. 1) of the print paper or backing web 8 to feed the print paper or backing web 8 when the belts 14 are turned by the drive pulleys 12. A paper holding cover 9*a* (refer to FIG. 3) is mounted for opening and closing motion on an upper face of each of the tractors 9 to prevent the print paper or backing web 8 with labels 7 from coming off from the corresponding belt 14.

In order to drive the tractors 9 of the construction described above in a synchronized relation with the platen roller 2, a tractor gear 16 is fitted to a left end portion of the drive shaft 10 and normally held in meshing engagement with a platen gear 19 by way of a pair of intermediate gears 17 and 18 as shown in FIG. 3. Here, the platen gear 19 is fitted on a center shaft 20 of the platen roller 2 while the intermediate gear 17 is held in meshing engagement with a motor gear 22 fitted on a rotary shaft of a paper feeding motor 21. Accordingly, when the paper feeding motor 21 rotates, the tractors 9 and the platen roller 2 are driven to rotate simultaneously.

Meanwhile, a label separating device 23 is removably mounted on the printing system body obliquely upwardly (in the paper feeding direction) of the platen roller 2. The label separating device 23 includes two separating rollers 24 and 25 and two pull tractors 26 serving as a backing web feeding mechanism, and those elements are formed as a unit in the following manner. In particular, referring to FIGS. 1 and 2, the two separating rollers 24 and 25, a drive shaft 27 and a guide shaft 28 are supported on a pair of left and right support plates 29. Drive pulleys 30 of the pull tractors 26 are fitted on the opposite left and right portions of the drive shaft as shown in FIG. 4, and belts 32 extend between the drive pulleys 30 and follower pulleys 31 located obliquely upwardly of the drive pulleys 30. Engaging projections 32*a* are provided on outer peripheries of the belts 32 and adapted to be engaged in the sprocket holes 15 of the backing web 8 to draw out, when the belts 32 are turned, the backing web 8 from the separating roller 25. A paper holding cover 26*a* is provided for opening and closing movement on an upper face of each of the pull tractors 26 to prevent print paper such as the backing web 8 with labels 7 from coming off the belt 32.

Figure 6:
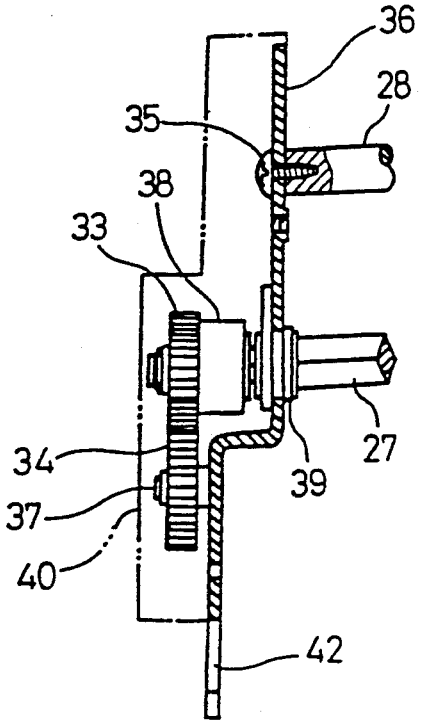
FIG. 6 is a transverse sectional view of components of the printing system of FIG. 1 concerning tractor gear.

In order to drive the pull tractors 26 in a synchronized relation with the platen roller 2, a tractor gear 33 is provided at a left end portion of the drive shaft 27 by way of a one-way clutch 38 (refer to FIG. 6). The tractor gear 33 is normally held in meshing engagement with the platen gear 19 serving as a driving mechanism by way of an intermediate gear 34. In this case, the one-way clutch 38 functions such that it permits only forward rotation (rotation indicated by an arrow mark A in FIG. 5) but prevents reverse rotation of the drive shaft 27. A pair of support frames 36 are secured to the opposite ends of the guide shaft 28 by means of fastening screws 35. The drive shaft 27 is rotatably supported at the opposite ends thereof on the support frames 36 by way of bearings 39. It is to be noted that the tractor gear 33 and the intermediate gear 34 are covered with a cover 40 mounted on a left-hand side one of the support frames 36.

In the meantime, the two separating rollers 24 and 25 are rotatably mounted on and between the support plates 29 and extend in parallel to the platen roller 2. The separating rollers 24 and 25 and the tractors 26 are disposed such that a passage for the backing web 8 defined by the separating roller 24 at the preceding stage and the other separating roller 25 at the following stage may make a sufficient angle to separate a label 7 from the backing web 8 with respect to a passage for the backing web 8 defined by the separating roller 25 at the following stage and the tractors 26. Thus, the backing web 8 with labels 7 fed out from the platen roller 2 is fed in a zigzag fashion to cause a label 7 to be peeled from the backing web 8.

Subsequently, description is given of a structure in which the label separating device 23 is removably supported on the printing system body 1. In particular, each of the support frames 36 has a forwardly directed semicircular fitting recess 42 formed at a lower portion thereof for fitting with a bearing 41 on the center shaft 20 of the platen roller 2. Each of the support frames 36 has an engaging lever 44 mounted for pivotal motion on an inner side thereof by means of a pin 43, and the engaging lever 44 is urged to pivot in the direction indicated by an arrow mark B in FIG. 5 by a tension spring 45. The engaging lever 44 has a knob portion 46 formed at an upper end thereof while a hook portion 47 is formed in a rearward direction at a lower end of the engaging lever 44. The engaging levers 44 are disposed such that the hook portions 47 thereof may be engaged with engaging pins 48 provided on the opposite side portions of the printing system body 1.

Subsequently, operation of the printing system of the construction described above is described. In order to print on labels 7 adhered to a backing web 8, the label separating device 23 is first mounted in position onto the printing system body 1 in the following procedure. First, the fitting recesses 42 of the two support frames 36 are fitted onto the bearings 41 of the platen roller 2. In this condition, the engaging levers 44 are pivoted suitably in the direction opposite to the direction indicated by the arrow mark B in FIG. 5 against the urging force of the tension springs 45 so that the hook portions 47 thereof may be engaged with the engaging pins 48. Such engaging condition is thereafter retained by the urging force of the tension springs 45. Upon such engagement, the intermediate gear 34 of the left-hand side pull tractor 26 is put into meshing engagement with the platen gear 19. After then, the backing web 8 with labels 7 is set in position such that the sprocket holes 15 thereof are engaged with the engaging projections 14*a* of the lower tractors 9. Then, a paper feeding switch 61 on an operation panel 60 of the printing system body 1 (refer to FIG. 7) is operated to cause the paper feeding motor 21 to rotate forwardly. Upon such rotation, the belts 14 of the tractors 9 are turned and the platen roller 2 is rotated forwardly by way of the gears 16 to 19 to feed the backing web 8 with labels 7 forwardly. Then, after the backing web 8 with labels 7 is suitably fed forwardly, the paper feeding motor 21 is stopped. After then, the backing web 8 with labels 7 is threaded between the separating rollers 24 and 25 such that it may extend in a zigzag fashion, and then the backing web 8 is set such that the sprocket holes 15 thereof are engaged with the engaging projections 32*a* of the pull tractors 26. Then, a print key 62 on the operation panel 60 is operated. Consequently, the print head 4 prints on a label 7 on the backing web 8 while the carriage 3 moves along the platen roller 2. After printing for a print line is completed, the paper feeding motor 21 is rotated forwardly to line space the backing web 8. After then, a printing operation for a print line and a line spacing operation are performed alternately.

Upon line spacing, rotation of the paper feeding motor 21 is transmitted to the tractors 9, platen roller 2 and pull tractors 26 by way of the gears 16 to 19, 33 and 34. Then, as the belts 32 of the pull tractors 26 are turned, the backing web 8 is drawn out in a zigzag fashion by the separating roller 25. Due to such zigzag fashion, a label 7 is automatically peeled off from the backing web 8.

On the other hand, in printing on normal print paper, the label separating device 23 is removed from the printing system body 1 in the following manner. First, the engaging levers 44 are pivoted in the opposite direction to that indicated by the arrow mark B in FIG. 5 against the tension springs 34 to disengage the hook portions 47 thereof from the engaging pins 48, and then, the fitting recesses 42 of the support frame 36 are disengaged from the bearings 41 of the platen roller 2. Consequently, the entire label separating device 23, that is, the two separating rollers 24 and 25 and two pull tractors 26, can be removed in an integral relationship from the printing system body 1. After then, the print paper may be set in position on the platen roller 2 and a printing operation may be started.

According to the construction described above, the two separating rollers 24 and 25 and two pull tractors 26 are constituted into a unit as the label separating device 23. Since the label separating device 23 is removably supported on the printing system body 1, a user can mount or remove the label separating device 23 onto or from the printing system body 1 depending upon whether the paper to be used is a backing web 8 with labels 7 or normal print paper. Since the label separating device 23 is constituted in an integral relation as a unit from the separating rollers 24 and 25 and pull tractors 26, a user can mount or remove the label separating device very easily, and accordingly, the operability of the printing system is very high. Accordingly, proper use of the printing system for printing on a backing web 8 with labels 7 or for printing on normal print paper can be performed very readily, and accordingly, the printing system is very convenient in use. Additionally, since the intermediate gear 34 is connected to the platen gear 19 on the printing system body 1 side when the label separating device 23 is mounted on the printing system body 1, the backing web 8 is fed with certainty by the pull tractors 26 even after it has passed the printing station. Accordingly, the label separating device 23 is not deteriorated in performance in peeling a label 7 from the backing web 8.

Figure 8:
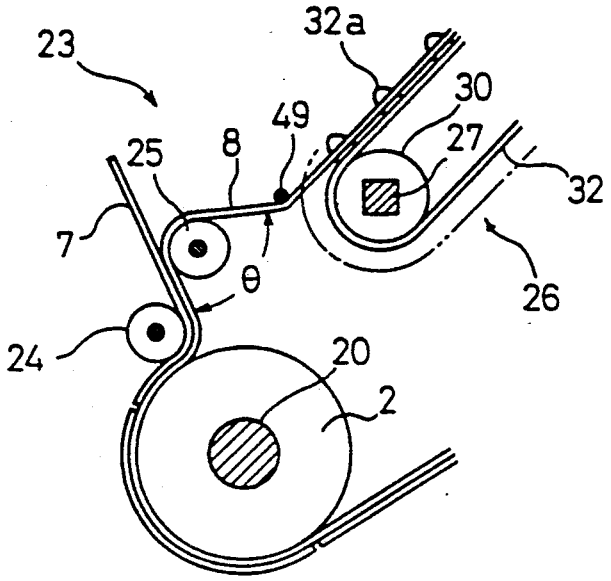
FIG. 8 is a vertical sectional side elevational view of another printing system showing a second embodiment of the present invention.
Figure 9:
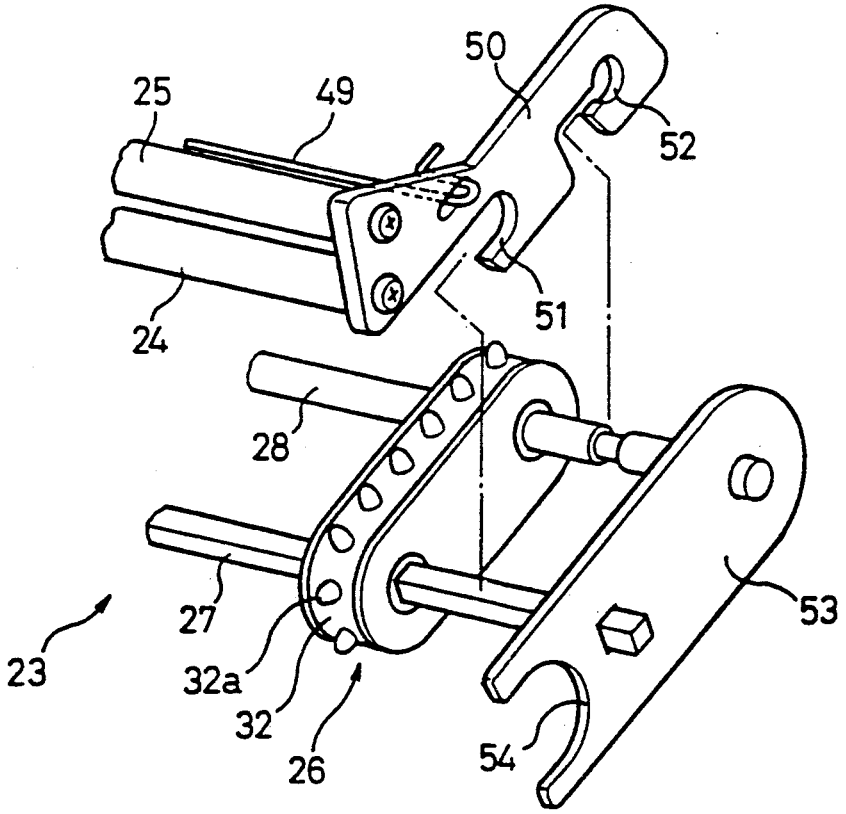
FIG. 9 is a fragmentary perspective view of the printing system shown in FIG. 8.

Referring now to FIGS. 8 and 9, there is shown a printing system according to a second embodiment of the present invention. The printing system of the present embodiment is different from the printing system of the first embodiment in that a backing web holder 49 is disposed between the separating roller 25 and the pull tractors 26. The backing web holder 49 holds a backing web 8 such that the bending angle $\theta$ of the backing web 8 at the separating roller 25 may be decreased to make it possible to peel a label 7 readily from the backing web 8. In this instance, the backing web holder 49 is so provided as to extend between the support plates 50 mounted at the opposite ends of the separating rollers 24 and 25. Those elements are constituted into a unit as a label separating device 23 in such a condition that engaging portions 51 and 52 formed on the support plates 50 are engaged with the drive shaft 27 and the guide shaft 28 for the pull tractors 26. The present label separating device 23 is similar to the label separating device 23 of the printing system of the preceding embodiment in that engaging levers are engaged with the engaging pins 48 on the printing frame body I side in a condition wherein fitting recesses 54 of support frame 53 on which the opposite ends of the drive shaft 27 and the guide shaft 28 are supported are fitted on the bearings 41 of the platen roller 2.

It is to be noted that, while the support frames or 53 of the label separating device 23 in the printing system of either of the first and second embodiments described above are supported on the two bearings 41 of the platen roller 2, they may otherwise be supported at some other suitable location.

Further, the label separating device 23 may be removably supported on the printing system body 1 otherwise by some other simple means such as, for example, a clamp mechanism. Thus, the present invention may be embodied in various manners.

What is claimed is:

1. A printing apparatus for printing on a label removably adhered to a backing web as well as printing on a normal sheet comprising:
   - a printing unit for printing input data on print medium including the label and the normal sheet;
   - a print medium feeding means for feeding the print medium out of the printing unit;
   - a pair of separating rollers downstream of said printing unit for guiding the backing web with labels in a zigzag fashion to peel a label from the backing web;
   - a backing web feeding mechanism for drawing the backing web from the separating rollers; and
   - a frame supported removably on the printing apparatus, and means for mounting said separating rollers and said backing web feeding mechanism on said frame.

2. Apparatus as in claim 1, and further comprising means positioned between the separating rollers and the backing web feeding mechanism for bending the backing web to enhance label separation.

3. The printing apparatus of claim 1, wherein the frame is removably supported by the print medium feeding means.

4. The printing apparatus of claim 3, wherein the print medium feeding means is a platen roller mounted on a shaft, and the frame is removably supported by the shaft.

5. The printing apparatus of claim 1, wherein the separating rollers are freely rotatable.

6. A printing apparatus for printing on a label removably adhered to a backing web as well as printing on a normal sheet comprising:
   - a printing unit for printing input data on a print medium including the label and the normal sheet;
   - a platen roller mounted on a shaft for guiding the print medium at the printing unit and for feeding the print medium printed at the printing unit out of the printing unit;
   - a platen drive means for rotating the platen roller:
   - a pair of separating rollers downstream of said printing unit for guiding the backing web with labels in a zigzag fashion to peel a label from the backing web;

a backing web feeding mechanism for drawing the backing web from the separating rollers;

a frame supported removably on the shaft of the platen roller, and means for mounting said separating rollers and said backing web feeding mechanism on said frame; and transmitting means for transmitting power from the platen drive means to the backing web feeding mechanism and enabling said backing web feeding mechanism to operate when said frame is mounted on the printing apparatus.

7. Apparatus as in claim 6, and further comprising means positioned between the separating rollers and the backing web feeding mechanism for bending the backing web to enhance label separation.

8. The printing apparatus of claim 6, wherein the separating rollers are freely rotatable.

9. Printing apparatus for printing on paper and web mounted adhesive backed labels comprising:

printing means for printing data on said paper and labels;

feeding means for feeding paper and said labels to said printing means to be printed;

drive means for driving said feeding means;

label separating means for separating said labels from said web;

means for readily removably mounting said label separating means on said printing apparatus downstream from said printing means; and said label separating means comprising:

means for drawing said web away from said printing means to place tension on said web;

means for driving said drawing means; and means for transmitting power from said drive means to said means for driving said drawing means.

10. Apparatus as in claim 9, wherein the drawing means comprises a pair of tractors.

11. Apparatus as in claim 9, wherein said separating means further comprises means upstream of the drawing means for defining a zigzag path for said label web, to thereby cause said labels to separate from said web.

12. Apparatus as in claim 5, and further comprising a platen rotatable about an axis and at least one engaging element;

said label separating means including a frame extending substantially parallel to the platen;

a pair of mounting elements, one at each end of the frame;

each mounting element including means for pivotally mounting the frame about the axis of rotation of the platen and at least one mounting element including a releasable locking means for engaging said engaging element to prevent rotation of said frame.

13. Apparatus as in claim 9, and further comprising means positioned between the separating rollers and the backing web feeding mechanism for bending the backing web to enhance label separation.

14. The printing apparatus of claim 9, wherein the label separating means is a pair of freely rotatable rollers.

15. The printing apparatus of claim 11, wherein the means for defining a zigzag path is a pair of freely rotatable rollers.

16. The printing apparatus of claim 12, wherein the label separating means is a pair of freely rotatable rollers.

* * * * *